US006609307B1

(12) United States Patent
Haynes et al.

(10) Patent No.: US 6,609,307 B1
(45) Date of Patent: Aug. 26, 2003

(54) LASER SYSTEM FOR POSITIONING A RACK FOR A POOL GAME

(76) Inventors: Joel A. Haynes, 15814 Jolly Rd., Marysville, OH (US) 43040-8982; Fred L. Lowe, 16059 Springdale Rd. South, Marysville, OH (US) 43040

( * ) Notice: Subject to any disclaimer, the term of this patent is extended or adjusted under 35 U.S.C. 154(b) by 0 days.

(21) Appl. No.: 10/183,699

(22) Filed: Jun. 28, 2002

(51) Int. Cl.[7] ..... A63D 15/00

(52) U.S. Cl. ..... 33/286; 33/227; 33/DIG. 21; 473/2

(58) Field of Search ..... 33/227, 228, 263, 33/264, 286, 289, DIG. 21; 473/2, 21, 26

(56) References Cited

U.S. PATENT DOCUMENTS

| | | | | |
|---|---|---|---|---|
| 3,909,952 | A | 10/1975 | Lagasse | |
| 3,911,588 | A | 10/1975 | Ohneda | |
| 4,885,967 | A | 12/1989 | Bell et al. | |
| 5,163,229 | A | 11/1992 | Cantone | |
| 5,478,282 | A | 12/1995 | Possum et al. | |
| 5,481,809 | A | 1/1996 | Rooney | |
| 5,846,137 | A | 12/1998 | Tremblay | |
| 5,853,333 | A | 12/1998 | Patterson | |
| 6,371,860 | B1 * | 4/2002 | Anderson | 473/1 |
| 2002/0032068 | A1 * | 3/2002 | Belknap | 473/4 |

* cited by examiner

*Primary Examiner*—Christopher W. Fulton
*Assistant Examiner*—Tania C. Courson
(74) *Attorney, Agent, or Firm*—Donald R. Schoonover

(57) ABSTRACT

A system of lasers is used to precisely locate the spot for placing a racked set of pool balls and to identify the porch line of a pool game.

6 Claims, 1 Drawing Sheet

LASER SYSTEM FOR POSITIONING A RACK FOR A POOL GAME

BACKGROUND OF THE INVENTION

1. Field of the Invention

The present invention relates to the general art of games, and to the particular field of pool-type games.

2. Discussion of the Related Art

Pool-type games have always been extremely popular. Pool tables are often found in restaurants, bars and even businesses entirely devoted to pool and pool-type games. The present disclosure will refer to "pool" and "pool-type games" by which it is meant to include all types of such games, including, but not limited to, pool, billiards and the like. The terms "pool-type games" and "pool" are meant to include all such games.

Tables in such establishments are nearly always crowded as evidence of the popularity of such pastimes. Tournaments including such pool-type games are also extremely popular both to participants and to spectators. Pool-type games are also extremely popular in homes and residences. It appears that the popularity of pool, even at current high levels, is increasing.

With the increased popularity of pool, the desire and need for accessories has concomitantly increased. These accessories generally include cues, racks, bridges and the like.

However, an overlooked area of the game of pool, especially in competitive situations, is the requirement for accurate, precise and repeatable location of an initial rack. In order to be entirely fair to all players, an initial rack should be precise and repeatable for all games.

Therefore, there is a need for a means for precisely, accurately and repeatably locating an initial rack for a pool game.

Many pool tables include a mark physically placed on the top surface of the playing table to identify the location of the placement of an initial rack. This mark generally coincides with the location of one of the balls of the rack. The ball is placed on top of this mark and the remainder of the rack is positioned with respect to the placed ball by using a frame, also known as a rack. The frame contains the playing balls and places them on the top surface of the playing table with respect to the placed ball, which has been placed on top of the mark on the top surface of the table. Once the balls have been stabilized, the frame is removed and the game is begun by placing a cue ball in a permitted area and driving the cue ball into the balls of the rack using a cue. The player making this initial break must do so with the cue ball located in the permitted area and without crossing a line, usually an imaginary line, on the playing surface during the break procedure.

It is often a matter of judgement as to whether a player has violated the imaginary line across which he or she cannot cross during a break. Still further, if, for some reason, the initial break must be repeated, the balls must be re-racked and re-broken. To be entirely fair, the imaginary line should be as definitive as possible and the racking and/or re-racking of the balls should be as precise, accurate and repeatable as possible.

While somewhat effective, the marks physically placed on the playing surface of the table and the use of imaginary lines have several drawbacks.

This means of identifying the initial spot requires placing a physical mark on the top surface of the table. In some situations, the physical mark may affect the movement of balls contacting the mark. Such movement can be extremely slight, but in some situations, such as highly competitive tournaments involving evenly matched players, such movement, even though extremely slight, could affect the outcome of a game.

Still further, a physical mark on the playing surface may affect the aesthetics of the playing surface. Also, it may give some players an advantage in lining up a shot.

Still further, a physical mark on the playing surface of a pool table may be a source of wear that differs from the wear of other areas of the playing surface. Thus, the overall playing surface may have to be replaced because the rack spot mark or the area surrounding the rack spot mark may wear out at a rate that is different from the wear of the remainder of the playing surface. This can be costly, not only from a material and a manpower standpoint, because it requires a table to be temporarily removed from service. Removing a table from service may be costly to an establishment that relies on pool tables to attract customers.

In addition to the above, having a physical spot on the playing surface of a pool table makes accuracy, precision and repeatability associated with the initial spot of a rack difficult. The physical mark is on the top surface of the table and the balls are placed on top of the mark. Thus, by definition, the physical mark will be hidden when in use. Accordingly, exact, precise and repeatable placement of the balls with respect to the spot mark will not be achievable because the mark is hidden when in use and a person placing the balls on the mark must guess exactly where the mark is on the surface of the table. While this drawback may not be significant in many situations, it may affect the outcome of a game involving closely matched opponents.

Therefore, there is a need for a means for precisely, accurately and repeatably locating a rack for a pool game that does not require the use of a physical mark placed on or incorporated into the top surface of the pool table.

Furthermore, as discussed above, using an imaginary line to divide the playing surface into a permitted area and a forbidden area can create problems associated with judging when a player has illegally moved into the forbidden zone. Again, while this may not be a significant drawback in many situations, it can be a problem in some cases, especially involving highly competitive games. Still further, there is no need to introduce a source of contention into an otherwise friendly game if it is not necessary.

Therefore, there is a need for a means for precisely, accurately, repeatably and clearly locating a dividing line on the surface of a pool table to divide the playing surface into a forbidden area and a permitted area for use during the game, such as during a break step.

PRINCIPAL OBJECTS OF THE INVENTION

It is a main object of the present invention to provide a means for precisely, accurately and repeatably locating an initial rack for a pool game.

It is another object of the present invention to provide a means for precisely, accurately and repeatably locating a rack for a pool game that does not require the use of a physical mark placed on or incorporated into the top surface of the pool table.

It is another object of the present invention to provide a means for precisely, accurately, repeatably and clearly locating a dividing line on the surface of a pool table to divide the playing surface into a forbidden area and a permitted area for use during the game, such as during a break step.

It is another object of the present invention to provide a means for precisely, accurately and repeatably locating a rack for a pool game that does not interfere with the overall aesthetics of the table.

It is another object of the present invention to provide a means for precisely, accurately and repeatably locating a rack for a pool game that does not require a physical mark to be incorporated into the top surface of the playing table.

SUMMARY OF THE INVENTION

These, and other, objects are achieved by a pool rack placement system which includes a laser spot generating unit and a laser line generating unit. The spot generating unit generates a spot on the top surface of the table at which one of the balls is located during the initial break and will be visible on the ball during placement of the balls. The line generating unit generates a line across the width dimension of the table to divide the table into areas where the balls are placed for the initial rack and where a player may place the cue ball for the initial break.

The spot will be visible on the ball during the set up of the rack so placement of the rack will be accurate, precise and repeatable. Once the initial rack has been placed, the laser spot can be turned off, and there will be no physical mark on the top surface of the table. This will eliminate all of the drawbacks associated with a physical spot on the playing surface.

Once the initial break has been successfully made, the laser line can be turned off or will be turned off automatically by a timer circuit. During the initial break, the line will be clear and thus any judgement calls associated with a player crossing this line, sometimes known as the "porch line," will be quite clear and easy. Again, once the laser line generator is de-activated, there will be no physical marks on the playing table and the drawbacks associated with such marks will be eliminated.

The system embodying the present invention includes timing circuits so such circuits can be used as desired to play the game.

DETAILED DESCRIPTION OF THE INVENTION

Figures 1, 2, 3, 4:
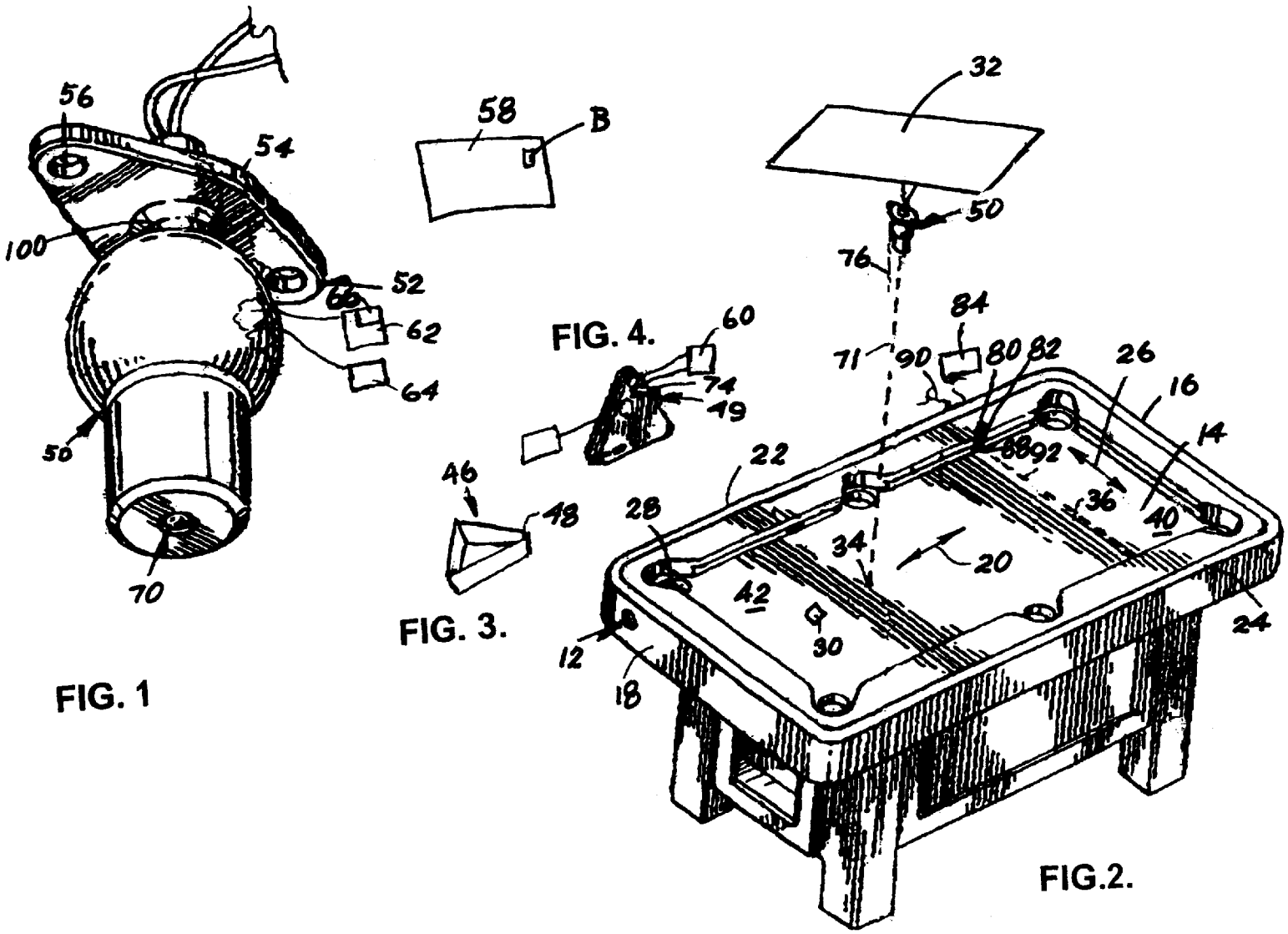
FIG. 1 is a perspective view of a laser spot generating unit used in the system of the present invention.
FIG. 2 is a perspective view of a pool table which uses the system embodying the present invention.
FIG. 3 is a rack used to initially place balls on a pool table during a game.
FIG. 4 is a wall-mounted unit that includes a support element for a rack and an on/off switch that controls operation of the system embodying the present invention.

Other objects, features and advantages of the invention will become apparent from a consideration of the following detailed description and the accompanying drawings.

The pool rack placement marking system of the present invention permits a rack of pool balls to be precisely, accurately and repeatably located at a precise location on the top surface of a pool table without interfering with the game or changing the makeup of the top surface of the table and clearly generates a line that is used to define an area from which a player can locate a cue ball to begin the game.

Referring to the Figures, it can be seen that the present invention is embodied in a pool rack placement marking system comprising a table 12 for playing a pool-type game which includes a top surface 14 having a first end 16, a second end 18, a length dimension 20 extending between first end 16 and second end 18, a first side 22, a second side 24, and a width dimension 26 extending between first side 22 and second side 24. Table 12 further includes targets, such as pockets 28, used in the pool-type game. A plurality of pool-type balls, such as ball 30 are also included.

The system includes a support, such as a ceiling 32, positioned above top surface 14 of table 12.

A selected spot 34 is located on top surface 14 of table 12 precisely at which a lead pool-type ball 30 is placed for a break to begin a pool-type game. Heretofore, this spot has been identified by a marker that is physically incorporated into the table. A selected line 36 extends across width dimension 26 of top surface 14 of table 12. Selected line 36 is spaced from selected spot 34 along length dimension 20 of top surface 14 of table 12 and divides top surface 14 into a permitted area 40 and a forbidden area 42, with selected spot 34 being located in forbidden area 42. As is known to those skilled in the art of pool and pool-like games, a player must place a cue ball in permitted area 40 to initiate an initial break to begin a pool game. Heretofore, dividing line 36 has been an imaginary line, subject to the interpretation of those involved with the game.

A rack 46 for confining the pool-type balls at a prescribed location on the top surface 14 of the table 12 to begin a pool-type game is indicated in FIG. 4. Rack 46 is triangular and includes at least one apex 48 which will contain the lead ball of a racked set of balls. This lead ball is placed on spot 34 to begin a game. As discussed above, if spot 34 is a physical mark on the top surface of the table, placing the racked balls on top of the spot will obscure the spot and thus make the racking process susceptible to variances. Rack 46 is removably associated with the pool-type balls and with top surface 14 of table 12 and is movable between a racking position confining the pool-type balls on the top surface 14 of the table 12 with one of the pool-type balls located on selected spot 34 and a non-use position spaced apart from the top surface 14 of the table 12. Once the balls are placed on the table 12 in the desired position, rack 46 is removed and placed in the non-use position thereof.

The system of the present invention further includes a storage element 49 on which rack 46 is placed in the non-use position.

The system of the present invention includes a laser spot generating unit 50 which includes a housing 52 mounted on support 32 above top surface 14 of table 12. The housing 52 may include a base 54 which is mounted on the ceiling 32 by fasteners or the like extending through fastener-receiving openings, such as opening 56, into the ceiling 32. Adhesive or magnets can also be used if desired. Generating unit 50 further includes a power source 58 which can be batteries, such as battery B, or can be the power source of a building. Unit 50 further includes an on/off switch 60 and circuitry 62 in housing 52 and connected to power source 58 via on/off switch 60 when on/off switch 60 is in an "on" position. A laser light spot generator 64 is located in housing 52 and is connected to and controlled by circuitry 62 to be activated when on/off switch 60 is in the "on" position.

A timer circuit 66 is located in housing 52 and is connected to circuitry 62 of laser spot generating unit 50 to maintain laser light spot generator 64 active for a pre-set period of time after the on/off switch is moved into an "off" position. This pre-set period of time can be used to re-rack the balls if desired.

Lenses, including lens 70, are mounted on housing 52 of laser spot generating unit 50 and are optically connected to laser light spot generator 64 and are oriented and positioned with respect to laser light spot generator 64 and with respect to top surface 14 of table 12 to focus laser light generated by laser light spot generator 64 onto selected spot 34 on top surface 14 of table 12 when laser light spot generator 64 is activated. This is indicated in FIG. 2 by dotted line 71. Spot 34 can be initially identified using a plumb system. Once spot 34 is initially identified and unit 50 is aligned with that spot, no further adjustments are necessary.

The system of the present invention further includes a rack support element 74 connected to on/off switch 60 of laser spot generating unit 50 to move the on/off switch 60 into the "off" position when rack 46 is supported on rack support element 74. As shown, rack support element 74 is a dowel rod, but can also be a chain, indicated by reference 76, connected to housing 52 with an on/off switch being located in housing 52.

The system of the present invention further includes a laser line generating unit 80 which is similar to the afore-discussed spot generating unit 50 and thus will not be fully shown in the Figures for the sake of the clarity of the Figures. Generating unit 80 includes a housing 82 mounted on first side 22 of top surface 14 of table 12 adjacent to the top surface of the table, circuitry 84 connected to power source 58 of laser spot generating unit 50 via on/off switch 60 of laser spot generating unit 50. A laser light beam generator 88 is located in housing 82 of laser line generating unit 80 and is electrically connected, as by lead lines 90, or the like, to circuitry 62 of laser spot generating unit 50 to be controlled by and to be activated by circuitry 62 of laser spot generating unit 50 when on/off switch 60 of laser spot generating unit 50 is in the "on" position. Laser spot generator 88 can include a vibrating mirror if suitable.

Lenses, similar to lens 70, are mounted on housing 82 of laser line generating unit 80 on first side 22 of top surface 14 of table 12 and which are oriented and positioned with respect to laser light beam generator 88 of laser line generating unit 80 and with respect to top surface 14 of table 12 to direct a laser light beam generated by the laser light beam generator 88 of laser line generating unit 80 precisely along selected line 36 from first side 22 of top surface 14 of table 12 to second side 24 of the top surface of the table when the laser light beam generator 88 is activated. The light beam is indicated by reference number 92 in FIG. 2.

If desired, storage element 48 can be mounted on a second support, such as a wall located adjacent to the table.

Another form of the system may have laser units 50 and 80 in one housing, such as housing 52. In such a form, laser unit 80 may be focused by its lenses on line 36 from housing 52 and moving mirrors may be used to establish line 92 from a laser located in housing 52 mounted above the table. A swivel ball mechanism 100 may be included in housing 52 to make any small adjustments necessary. Furthermore, one form of the invention may make housing 52 movable to move spot 34 and line 92 to either end of the table. AC/DC adapters may also be used as necessary in the power source.

The lasers, the laser circuits, the timer circuits and the like can be off-the-shelf items and thus will not be discussed since the exact form of these circuits and the exact elements of these items do not form the basis of this invention.

It is understood that while certain forms of the present invention have been illustrated and described herein, it is not to be limited to the specific forms or arrangements of parts described and shown.

We claim:

1. A pool rack placement marking system comprising:

a) a table for playing a pool-type game comprising:
  (1) a top surface having
    (A) a first end,
    (B) a second end,
    (C) a length dimension extending between the first end and the second end,
    (D) a first side,
    (E) a second side, and
    (F) a width dimension extending between the first side and the second side,
  (2) targets used in the pool-type game, and
  (3) a plurality of pool-type balls;

b) a support positioned above the top surface of said table;

c) a selected spot on the top surface of said table precisely at which a lead pool-type ball is placed for a break to begin a pool-type game;

d) a selected line extending across the width dimension of the top surface of said table, said selected line being spaced from said selected spot along the length dimension of the top surface of said table and dividing the top surface of said table into a permitted area and a forbidden area, with said selected spot being located in the forbidden area;

e) a rack for confining the pool-type balls at a prescribed location on the top surface of said table, to begin a pool-type game, the rack being removably associated with the pool-type balls and with the top surface of said table and being movable between a racking position confining the pool-type balls on the top surface of said table with one of said pool-type balls located on said selected spot and a non-use position spaced apart from the top surface of said table;

f) a storage element on which said rack is placed in the non-use position;

g) a laser spot generating unit which includes
  (1) a housing mounted on an upper surface above the top surface of said table,
  (2) a power source,
  (3) an on/off switch,
  (4) circuitry in the housing and connected to the power source via the on/off switch when the on/off switch is in an "on" position,
  (5) a laser light spot generator in the housing and connected to and controlled by the circuitry to be activated when the on/off switch is in the "on" position,
  (6) a timer circuit in the housing and connected to the circuitry of said laser spot generating unit to maintain the laser light spot generator active for a pre-set period of time after the on/off switch is moved into an "off" position, and
  (7) lenses on the housing of said laser spot generating unit which are optically connected to the laser light spot generator and which are oriented and positioned with respect to the laser light spot generator and with respect to the top surface of said table to focus laser light generated by the laser light spot generator onto said selected spot on the top surface of said table when the laser light spot generator is activated;

h) a rack support element connected to the on/off switch of said laser spot generating unit to move the on/off switch into the "off" position when said rack is supported on said rack support element; and i) a laser line generating unit which includes (1) a housing mounted on the first side of the top surface of said table adjacent to the top surface of said table, (2) circuitry connected to the power source of said laser spot generating unit via the on/off switch of said laser spot generating unit, (3) a laser light beam generator in the housing of said laser line generating unit and which is electrically connected to the circuitry of said laser spot generating unit to be controlled by and to be activated by the circuitry of said laser spot generating unit when the on/off switch of said laser spot generating unit is in the "on" position, and (4) lenses mounted on the housing of said laser line generating unit on the first side of the top surface of said table and which are oriented and positioned with respect to the laser light beam generator of said laser line generating unit and with respect to the top surface of said table to direct a laser light beam generated by the laser light beam generator of said laser line generating unit precisely along said selected line from the first side of the top surface of said table to the second side of the top surface of said table when the laser light beam generator is activated.

2. The pool rack placement marking system as described in claim 1 wherein said rack support element includes a dowel rod.

3. The pool rack placement marking system as described in claim 2 further including a second support and with said rack support element and the on/off switch being mounted on said second support surface.

4. The pool rack placement marking system as described in claim 1 wherein said rack support element includes a chain.

5. The pool rack placement marking system as described in claim 4 wherein said rack support element is mounted on the housing of said laser spot generating unit.

6. The pool rack placement marking system as described in claim 1 wherein the power source includes a battery.

* * * * *